United States Patent [19]

Flavel

[11] 4,281,800

[45] Aug. 4, 1981

[54] OPERATION OF ASSOCIATED CRUSHING PLANT AND MILL

[75] Inventor: Malcolm D. Flavel, Appleton, Wis.

[73] Assignee: Allis-Chalmers Corporation, Milwaukee, Wis.

[21] Appl. No.: 90,657

[22] Filed: Nov. 2, 1979

[51] Int. Cl.[3] ..... B02C 21/00; B02C 25/00

[52] U.S. Cl. ..... 241/24; 241/34; 241/36; 241/37; 241/152 A

[58] Field of Search ..... 241/24, 29, 30, 33–37, 241/152 A

[56] References Cited

U.S. PATENT DOCUMENTS

| | | | |
|---|---|---|---|
| 3,783,252 | 1/1974 | Putman | 241/34 X |
| 3,784,115 | 1/1974 | Krijeer et al. | 241/34 X |
| 4,179,074 | 12/1979 | Flavel | 241/24 |

*Primary Examiner*—Mark Rosenbaum
*Attorney, Agent, or Firm*—Arthur M. Streich

[57] ABSTRACT

A method for operating a crushing and grinding facility is disclosed in which crushing of mine-run material is controlled to always match grinding feed requirements while both crusher(s) (10) and grinding mills (16) operate full time and draw full power during the hours of what may be unequal length working days. The grinding mill (16) is also operated to produce the maximum output of final product that is within its existing capabilities. At each of a succession of measurement times (e.g., every ½ hour during a 22-hour working day of the mill), the rate of production of final product by the grinding mill (6) is ascertained (as by 21, 22, 23) and projected to the end of the mill working day. At each such time, feed of mine-run material to the crusher (10) is adjusted (as by 27–33, 11) to a rate which, if maintained through the remaining portion of an 18-hour crusher working day, would cause production of a target quantity of crushed product (at 8) which would equal projected total daily production of ground product (at 9). However, the mill (16) will not maintain its prevailing rate of production because grindability of crushed material is unpredictably variable. Therefore, the projected 22-hour daily production of mill final product (at 9) is redetermined at the end of each time interval and is the bases for a new target for crusher production.

11 Claims, 5 Drawing Figures

OPERATION OF ASSOCIATED CRUSHING PLANT AND MILL

TECHNICAL FIELD OF THE INVENTION

This invention relates to a method and apparatus for operating a mineral comminuting facility that comprises a crushing plant through which material is processed to reduce it to crushed product of intermediate particle size and a grinding mill through which the crushed product is processed to further reduce it to final product of a predetermined smaller particle size. The invention is more particularly concerned with a method and apparatus for so operating such a facility as to achieve the maximum production that can be obtained from the facility, with optimum utilization of the facility and the energy available to it.

The present invention is closely related to the invention covered by my copending application Ser. No. 938,259 filed Aug. 30, 1978, now U.S. Pat. No. 4,179,074 granted Dec. 18, 1979, and the following explanation of the present invention assumes a knowledge of the disclosure in that copending application now U.S. Pat. No. 4,179,074.

BACKGROUND OF THE INVENTION

In a facility of the type to which the present invention relates, mine-run material is initially fed to a crushing plant that reduces it to particles of sizes suitable for feed to a grinding mill, and the grinding mill further reduces the material to a specified final particle size. Typically, the particle size of material fed to the grinding mill will be such that all of the material can pass through a ½ inch (12.7 mm.) mesh screen. It is recognized that some substantially larger particles or chunks are fed into an autogenous mill, but they are a minor portion of the input and can be considered as grinding agents rather than as material to be ground.

Disregarding such grinding agents, it is generally true that particles fed to a grinding mill should be no larger than a specified size but can be smaller than that size. In fact, it is desirable that the material be reduced as much as possible in the crushing plant because a crushing plant utilizes power more efficiently than a grinding mill. Other things being equal, where particles of material are of such size that they are acceptable for feed to a grinding mill, but could be further reduced in a crushing plant, the crushing plant will expend about half as much energy as the grinding mill in reducing the size of such particles by a given amount. However, any reduction in particle size of crushing plant product tends to be obtained at the expense of rate of output of the crushing plant because, other things being equal, the smaller the particle size of crushed product that it delivers, the less will be the quantity of such product that the plant produces in a given time.

Energy economy in the grinding mill component of a comminuting facility is manifested in faster grinding of the smaller particles, and hence in a higher rate of production for a given energy expenditure. Furthermore, this higher rate of production constitutes a more profitable utilization of the capital investment represented by the mill and is accompanied by decreased wear and tear on equipment and in lower labor and maintenance costs per ton of final product. In a sense, therefore, any reduction in the size of the coarsest particles fed to a grinding mill can result in a compounded economic gain. But of course this gain cannot be fully realized if the mill must at times stand idle because its production rate has exceeded that of a crushing plant which feeds it.

Considering a crushing plant and an associated grinding mill as a complete facility, it follows from the superior energy efficiency of the crushing plant that the greater the amount of energy expended by it in actual crushing of material, the less is the total amount of energy consumed by the complete facility in processing a given quantity of mine-run material to final product. However, energy efficiency is only one factor in the economical operation of the facility; for the most profitable utilization of the invested capital, the production rate of the crushing plant should be matched to that of the grinding mill, so that neither is idle when it could be working.

My copending application discloses a method of operating a crushing plant to greatest advantage, but it treats the crushing plant as an independently operating entity which functions without regard to possible variations in the amount of feed material required by an associated grinding mill. According to that method, the rate of feed of raw material to the crushing plant is so controlled as to ensure that the plant will operate through the whole of each of its working periods to produce neither substantially more nor substantially less than a predetermined quota, and the operation of the crushing plant is further so controlled that at all times during the period it consumes the maximum amount of power available to it. With such operation of a crushing plant, its output will have optimum economic value because it will be in the smallest particle size attainable under the constraint imposed by the production quota and by existing physical conditions including the nature of the material to be crushed.

There are situations in which the daily quota for a crushing plant is established arbitrarily, as by fixed contractual obligations. In such cases the problem of operating the crushing plant to obtain an economically optimum product is solved by the invention of the copending application, now U.S. Pat. No. 4,179,074.

But there are a good many cases in which the determination of a proper quota for a crushing plant is in itself a problem. By way of example, if a grinding mill fed with the output of a crushing plant has a capacity such that it can process 75,000 tons of certain crushed product during each working day, and the program for the crushing plant yields 100,000 tons of crushed product per working day, there will be an unbalance between the crushing and the milling operations that will require early shutdown of the crushing plant each day. The facility that comprises the crushing plant and the grinding mill, considered as a whole, will not be operating to maximum advantage under these conditions, because the total available energy will not have been applied to the final product with optimum efficiency, the capital invested in the crushing plant will have yielded no return during its idle time, and substantial storage space will have had to be provided to accommodate the difference in production rates between the two operations. Furthermore, because all of the energy available to the crushing plant will not have been applied to its output, that output will be a relatively coarse material that will subject the components of the grinding mill to undue wear.

On the other hand, decreasing the quota of the crushing plant to the assumed 75,000 ton capacity of the grinding mill, and operating the crushing plant to require the whole of its working day for processing that tonnage would result in a substantial increase in the capacity of the grinding mill, owing to the smaller particle size of the crushed product fed to it from the crushing plant. In that case the crushing plant would not be supplying enough feed material for operation of the grinding mill at its full capacity, and again the facility as a whole would not be operating for optimum return on invested capital.

Thus the substantial capital investment in a facility comprising a crushing plant and a grinding mill is employed to full advantage only when each of those operations is working through the whole of the time in which it can normally be in operation. On the other hand, optimum energy efficiency is obtained with the facility if the crushing plant always consumes the maximum amount of energy available to it and produces exactly the quantity of crushed product that will keep the grinding mill operating full time.

From that analysis it is obvious that efficient operation of a comminuting facility requires maintenance of a substantial balance between the daily output of its crushing plant and the daily feed requirement of its grinding mill. What is not at all obvious—as is apparent from the simplified example given above—is how such balanced operation of a comminuting facility can be achieved along with optimum energy efficiency. Briefly stated, the problem is that the crushing plant cannot be operated to meet some fixed quota set by the grinding mill because the operation of the crushing plant controls the capacity of the grinding mill, which in turn tends to control how the crushing plant shall be operated.

There does not seem to be any mathematical model that could be reliably used for maintaining a balance between output of a grinding mill and output of an associated crushing plant, owing to the several unascertainable variables affecting that balance.

One factor affecting the problem is that the two types of operations tend to have different working cycles. Typically, a grinding mill can operate, on average, about 23 hours out of 24 and needs the equivalent of about one hour a day for maintenance, whereas a crushing plant operates an average of about 20 hours out of 24 and must be idle for maintenance during the remaining time. Although the availability of both the crushing plant and the grinding mill can be known in terms of daily averages over an extended period, particular episodes of down-time do not necessarily occur at regular intervals in either case.

A more difficult variable to deal with is presented by the material fed into the facility. To obtain maximum production for energy expended, both the grinding mill and the crushing plant must be so operated that each draws the full amount of power available to it all during the time that it is in operation, but the quantity of output obtained for a given energy expenditure by either operation depends upon the comminution properties of the material being processed and the various proportions of particle sizes in the mine-run raw material being fed to the facility. These are virtually unpredictable. If a balance between crushing plant and grinding mill outputs occurs by chance under one set of conditions, any change in the coarseness or crushability of the mine-run material fed to the facility will destroy that balance.

The general object of the present invention is to provide a method and apparatus for operating a comminuting facility comprising a crushing plant feeding into a grinding mill whereby the output of the crushing plant is balanced to the feed requirements of the grinding mill while each is operating full time and drawing all of the power available to it, thus enabling the capacities of the facility to be fully utilized for production of final product at the lowest possible cost per unit quantity and at the highest attainable rate.

Another and very important general object of the invention is to achieve substantial conservation of energy in the comminuting of minerals by providing for operation of a comminuting facility of the character described in a manner that will assure the most efficient utilization of the energy available to the facility and will consequently enable its final product to be produced at the lowest attainable energy cost per unit quantity.

It is also an object of this invention to provide a method of operating a comminuting facility comprising a crushing plant feeding into a grinding mill, wherein the crushing plant is operated in accordance with the method of the above-identified copending application, to afford maximum efficiency in the utilization of the power available to it, and whereby the operation of the crushing plant is nevertheless coordinated with operation of the grinding mill to afford optimum utilization of the facility as a whole and maximum efficiency in its overall operation.

A further object of the invention is to provide a method and apparatus for maintaining a constant substantial balance between the outputs of a crushing plant and of a grinding mill into which the crushing plant feeds, taking account of all of the variables and unknown quantities that influence the output of each while enabling both to be operated at optimum efficiency.

An additional important object of this invention is to make possible the efficient and satisfactory operation of a grinding mill that comprises on or more very large machines, and to overcome serious disadvantages heretofore encountered because of scale effect with grinding mill machines larger than a conventional size range.

It is known that as the size of grinding mill machines increases above the conventional size range, the capital cost of such very large machines does not increase in direct proportion to production capacity. With increasing size for larger machines, there is also a decrease in maintenance costs and non-energy operating costs as measured on the basis of tons per hour of final product, as well as a desirable saving in floor space. A very large machine, in and of itself, does not necessarily consume any more energy than a small one in effecting a given reduction of particle size of a given volume of a particular material. However, the volume of a grinding mill drum increases with the square of its diameter, whereas the power required to drive the machine increases as an exponential function of drum diameter that is substantially higher than 2. This means that the retention time per unit of energy input decreases with increasing drum size. As a result of this scale effect, the product that issues from a very large machine tends to be substantially coarser than that from a machine of conventional size; and therefore a grinding mill comprising a very large machine must also have relatively costly and elaborate classification and recirculating equipment whereby particles that are of larger than a desired final product size are separated from the rest of the output of the machine and sent back for further grinding. Such recirculation of course consumes energy, and the larger the recirculating load, the greater is the amount of energy consumed in recirculation, so that total energy consumption of a grinding mill comprising one or more very large machines may be greater than that of a mill comprising smaller conventional machines producing an equivalent output of like material reduced to the same particle size.

Aside from these energy cost considerations, it was found in some prior experiences with grinding mills comprising such larger machines that economically feasible operation was possible only upon condition that a final product be accepted that was coarser and less valuable than was desired. Owing in part to inherent deficiencies in classification equipment, an attempt to obtain a final product of the desired fineness would raise the rates of recirculation to such high levels that the quantity of recirculated material controlled the infeed of fresh material and reduced productivity to a point at which the operation as a whole became uneconomical.

Thus, another object of this invention as it relates to a comminuting facility that comprises a grinding mill equipped with very large machines is to secure the benefits of such machines without incurring the disadvantages which heretofore attended their use.

More specifically in this connection, it is an object of this invention to provide for the operation of such a facility in a manner that minimizes recirculating loads in the grinding mill so that the mill can be maintained in stable operation while producing a final product of desirably fine particle size with a total energy consumption for the mill as a whole that compares favorably with energy consumption by a grinding mill equipped with machines of conventionally smaller size and having an equivalent output of like material.

In connection with this last stated object of the invention, it is more particularly an object to provide for such operation of a facility as a whole that comprises a crushing plant and a grinding mill equipped with very large machines that at least a major portion of the material fed to the grinding mill from the crushing plant will be of small enough particle size to be capable of reduction to a desired final product size in a single pass through a grinding mill machine, thus in some cases eliminating the need for recirculating loads in the grinding mill that consume essentially unproductive energy, or, if recirculation is needed, reducing recirculating loads to a level low enough to avoid operating problems.

It is also an object of this invention to provide a simple method whereby a comminuting facility of the character described can be operated to achieve the above-stated objectives, and simple and inexpensive apparatus, comprising generally conventional components, by which the method can be implemented to provide for substantially automatic control of the operation of the facility.

SUMMARY OF THE INVENTION

In general, the objects of the invention are achieved by means of the herein described method of operating a comminuting facility that comprises a crushing plant into which material is fed as particles of random sizes and from which the material is delivered to a delivery zone as crushed product of intermediate particle size, and a mill to which said crushed product is fed and which produces therefrom final product of a predetermined smaller particle size. The method makes for optimum utilization of the capacities of the facility and of the energy available of it.

In the practice of the method: the grinding mill is so controlled that it produces final product at the maximum rate that is within its existing capabilities; from time to time the rate at which the grinding mill is producing final product is ascertained; unprocessed material is fed to the crushing plant at a rate such that the quantity of crushed product that it would deliver to the delivery zone at the end of an extended period if said rate were maintained to the end of that period would equal the quantity of final product that would be produced by the grinding mill by the end of the same extended period if the grinding mill were to maintain its prevailing rate of production of final product to the end of said period; and the crushing plant is so controlled that it is caused to deliver crushed product to the delivery zone at substantially the rate at which unprocessed material is fed to it, and to constantly consume the maximum amount of power available to it.

Briefly, therefore, in the method of the present invention the grinding mill is always operated to produce to the full extent of its available capacity, and the crushing plant is operated in accordance with the principles of the invention of the aforesaid copending application, now U.S. Pat. No. 4,179,074, but on the basis of a quota that changes from time to time as necessary to keep long-term production of the crushing plant equal to the long-term production of the grinding mill, which quota is set by making measurements from time to time of a function of prevailing rate of output of the grinding mill so that the prevailing quota for the crushing plant, to be achieved over an extended period of time, can be taken as equal to a projection of the total output that the grinding mill will achieve over the same period of time, based upon the prevailing rate of output of the grinding mill.

It will be seen that there are two essential features of this method: first, the pace-setting grinding mill must always operate at the maximum production rate that it can maintain under existing circumstances, and, second, its rate of production (or some function of that rate) must be ascertained from time to time so that the crushing plant can be operated to maintain the same rate—not on a step-for-step basis but on the basis that its production over an extended period (e.g., a day or a week) will substantially equal that of the grinding mill over the same extended period.

These essentials can be incorporated into various specific procedures that differ from one another in detail.

For example, it may be known that over a long term each of the crushing plant and the grinding mill has an availability equal to its actual operating time over an extended period, reduced to the equivalent of full capacity operation, divided by the time during that same period during which it would be operating if it did not need repairs or maintenance; and the feed rate to the crushing plant is maintained equal to the prevailing rate of production of the grinding mill multiplied by the ratio of grinding mill availability to crushing plant availability.

In a situation where shut-downs occur more or less regularly during a given period of time, the projected total outputs to the end of that period can actually be calculated in each case at each of a succession of measurement times during the period, for the purpose of determining needed adjustments to the crushing plant feed rate.

In most cases it will be necessary not only to ascertain, from time to time, the prevailing rate of production of the grinding mill but also to make a determination of the prevailing rate of delivery of crushed product to the crushing plant delivery zone. The rate of delivery of crushed product then serves as a bench mark value to which necessary upward and downward adjustments of the crushing plant feed rate can be related.

Apparatus by which the method can be implemented will be apparent from the foregoing summary of the method, and preferred forms of such apparatus are described hereinafter.

BRIEF DESCRIPTION OF DRAWINGS

FIGS. *3a* and *3b* respectively show measurements of crushing plant production for the same two measurement times and rate calculations made on the basis of those measurements and the projections shown in FIG. 2.

DETAILED DESCRIPTION OF THE INVENTION

Figure 1:
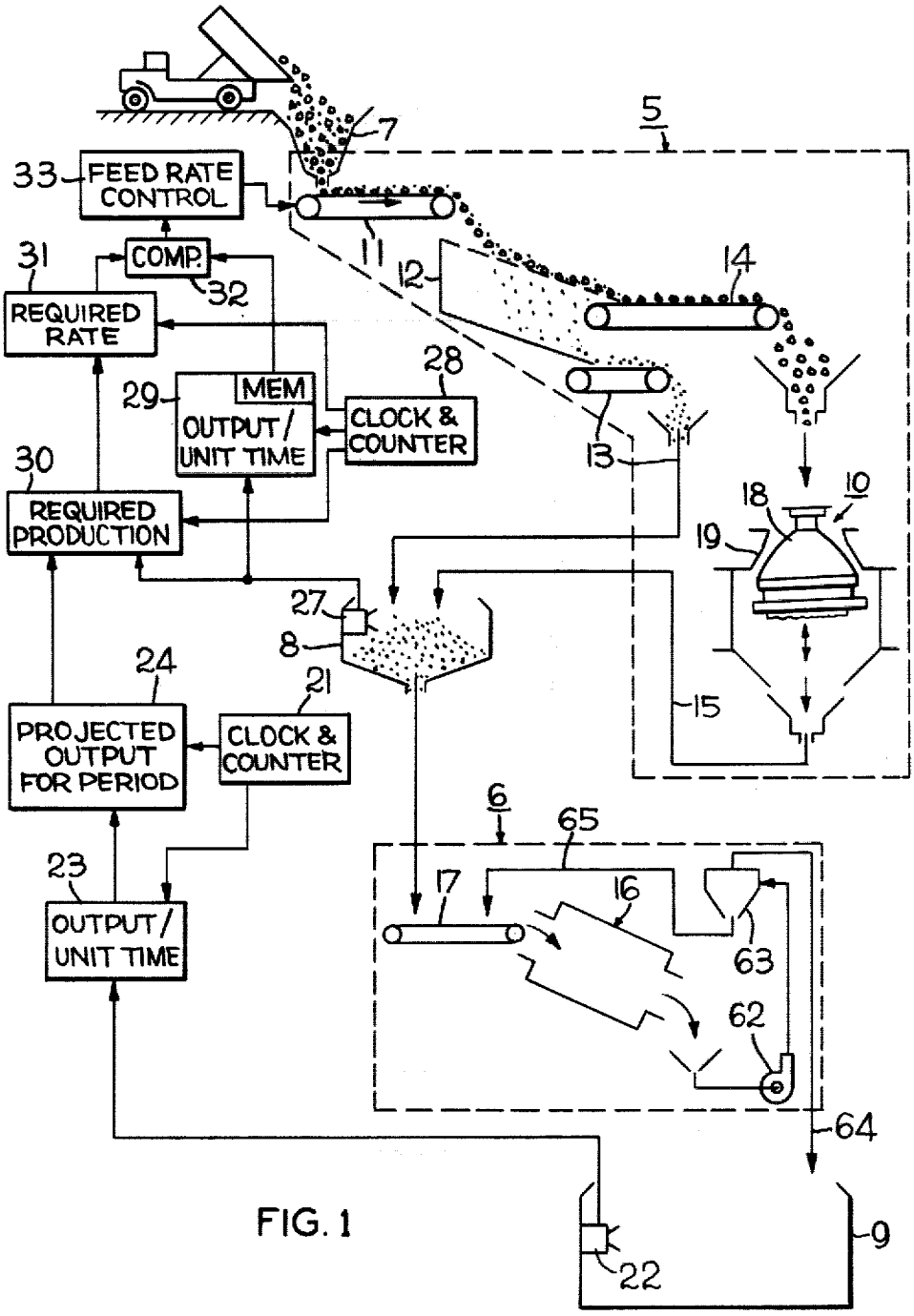
FIG. 1 is a more or less diagrammatic representation of a mineral comminuting facility which is controlled as to its operations by apparatus of the present invention and in which the method of the invention is practiced.

The mineral comminuting facility depicted in FIG. 1 comprises a crushing plant designated generally by 5 and a grinding mill designated generally by 6. Incoming mine-run raw material is delivered to a feed hopper 7 from which it is fed into the crushing plant 5. The crushed product of the crushing plant is delivered to a delivery zone 8 that serves for temporary storage and provides the source of feed material for the grinding mill 6. Material that has passed through the mill 6, constituting the final product of the facility as a whole, is sent to a storage location 9 from which it is taken for sale or further processing.

For simplicity, the crushing mechanism of the crushing plant 5 is illustrated as comprising only a single gyratory crusher 10. In practice, however, such a plant would comprise a number of crushers arranged as one or more primary crushers that received the coarsest feed material, one or more secondary crushers that received material in a size range somewhat smaller than that fed to the primary crusher or crushers, and possibly also a tertiary crusher or crushers to which relatively small material would be fed; and the crushers comprising the several stages might be of different types, such as cone crushers and impact crushers. The crushing plant would also include other elements not here shown, such as secondary screening and classifying devices for separating material according to predetermined ranges of particle size, distributing means for feeding classified material into the various crushers, and recirculating means for returning the coarsest material that has issued from a particular crusher back to that same crusher for recycling to be reduced to smaller size. From my copending application, now U.S. Pat. No. 4,179,074, it will be readily apparent how the present invention is applicable to a crushing plant embodying plural crushers and the various other features of a conventional high production crushing plant that are not here illustrated.

From the feed hopper 7 the mine-run material is fed to the crushing plant at a controlled rate, as by variable rate feed means 11. As it enters the crushing plant, the unprocessed material passes over a classifier 12. Usually an in-feed classifier has more stages than are here illustrated, so that it can classify the incoming material for selective feed to the respective primary and secondary crushers and the like; but for simplicity the classifier 12 is shown as separating the incoming material only into product-size particles—which are small enough to be fed directly to the grinding mill 6—and particles of larger than product size. From the classifier 12 product-size particles are sent directly to the delivery zone 8 by suitable transfer means 13, bypassing the crushing mechanism 10. The remainder of the incoming material is conveyed by suitable feed means 14 from the classifier 12 to the crushing mechanism 10. The output of the crushing mechanism is carried to the delivery zone 8 by transfer means 15.

From the delivery zone 8, crushed product is fed into the grinding mechanism 16 of the grinding mill 6 by means of a conveyor 17. It will be observed that the term "grinding mill" is used herein to designate the complete plant comprising one or more grinding machines, each of which is a grinding mill in the sense in which the term is more conventionally used.

In this case the grinding mill 6 is, for simplicity, illustrated as comprising a single grinding mill machine 16. Although recirculation equipment may not be needed, the grinding mill 6 is shown, for the sake of complete illustration, as comprising a pump 62 to which the output of the machine 16 is fed and which propels the material to and through a cyclone classifier 63. The cyclone 63 separates particles of final product size from coarser particles which need to be recycled. The particles of the desired small size are transported directly from the cyclone classifier 63 to the storage zone 9, as by a suitable conveyor 64, while the larger particles are carried back to the grinding mill feed conveyor 17 from the cyclone 63, as by a further conveyor 65.

It will be evident that, in general, the smaller the particle size of crushed product delivered to the delivery zone 8, the less will be the recirculating load fed back through the grinding mill recycling conveyor 65; and reduction of this recirculating load is in turn attended by a corresponding increase in the rate of output of final product of the grinding mill 6, delivered to the storage zone 9. Furthermore, as pointed out above, the particle size of final product from the grinding mill 6 is fixed by utilization requirements, whereas the particle size of crushed product is a variable that is substantially controllable by control of the operaton of the crushing plant 5.

With proper operation of the crushing plant 5, the rate at which crushed product is delivered to the delivery zone 8 is substantially equal to the rate at which unprocessed material is fed to the classifier 12 by the variable rate feed means 11. However, an unpredictably varying portion of the unprocessed material by-passes the crushing mechanism 10 as product-size particles carried by the transfer means 13. Such bypassed material must be regarded as part of the crushed product delivered to the delivery zone 8, since it constitutes part of the feed available to the mill 6. Hence, the rate of feed of raw material to the crushing mechanism 10 is somewhat variable and unpredictable, even when the rate of feed to the classifier 12 is known.

Such variations in feed rate are automatically accommodated as explained hereinafter, provided the crushing mechanism 10 is always operated in accordance with two criteria: the crushing mechanism must not be fed at such a high rate as to exceed the volumetric capability of any of its components, and it should at all times consume the maximum amount of power that is available to it, within the constraints imposed by its mechanical systems and the physical properties of the material fed to it.

To ensure that the crushing plant will not impose limitations upon the operation of the associated grinding mill, the capacity of the crushing plant 5 should be reasonably close to that of the grinding mill 6, so that the highest expectable feed rate to the crushing mechanism will not exceed the capacity of any part of it, and the feed to individual crushers comprising the crushing mechanism should be reasonably balanced as explained in my copending application. It is probable that some existing comminuting facilities, in order to be satisfactorily adapted to operation according to the principles of this invention, might benefit from increasing the capacity of the whole crushing plant or some part of it. In such cases, modification of the crushing plant should not be viewed as a cost entailed by the present invention but, instead, should be understood as a needed correction of a facility that has heretofore operated with an inherent but unrecognized inefficiency.

My copending application, now U.S. Pat. No. 4,179,074, also explains how the crushing plant can be operated so that it will at all times consume the maximum amount of power available to it. In the simple case here illustrated, wherein the crushing mechanism comprises the single crusher 10, that crusher can be assumed to be of a type that is adjustable while in operation to produce (other things being equal) a finer or a coarser product. Thus the crushing mechanism 10 is shown as a cone crusher having a power driven gyratory cone 18 that cooperates with a relatively stationary concave ring 19, and the cone and ring are adjustable in relation to one another to provide a variable spacing between them (called crusher setting) for control of energy imparted to feed material, with a corresponding effect upon product particle size. As is known, the crusher setting of such a crusher can be controllably varied to accommodate the prevailing feed rate while the crusher constantly draws the maximum power available to it, as in the case of the Allis-Chalmers "Hydrocone" crusher. Other expedients are also known for causing a crushing plant to consume the maximum amount of power available to it at all times that it is in operation. In a plant having multiple crushers, power draw at any given time can be controlled by controlling the distribution and recirculation of various-sized particles to the various crushers. Another possibility for controlling the rate at which material is put through a crusher, and thus controlling the amount of energy applied to a given amount of material, is to control the speed of the crusher.

In any case, when the crushing plant is controlled for constant consumption of maximum available power, the particle size of its output will of course vary and, other things being equal, will be larger with higher feed rates and smaller with slower feed rates. But because maximum available energy has always been applied to the crushed material, the particle size of the crushed product will always be the smallest (and therefore the most valuable) that can be obtained at the prevailing feed rate and with the particular material being fed.

In accordance with the principles of the present invention, the rate of feed to the crushing plant 5 is controlled on the basis of the rate of production of the grinding mill 6, as explained hereinafter. The grinding mill will either be of a type (metal media mill) that inherently draws all of the power available to it or, if it is an autogenous or semi-autogenous mill, it will be controlled to do so. Expedients for controlling grinding mill feed rate to maintain a constant and maximum power consumption are disclosed for example in U.S. Pat. Nos. 2,766,939 to Weston and 2,766,941 to Weston.

In any case, whenever the mill 6 can be operating, it is constantly caused to produce at its full available capacity, and it therefore operates at maximum efficiency with respect to utilization of both capital and energy. Since the final product delivered to the storage location 9 by the grinding mill 6 should be of a predetermined small particle size, and since the power consumed by the mill is at all times fixed as the maximum available to it, the rate of output of the mill will vary—and is permitted to vary—in accordance with such factors as size and hardness of the particles of material being fed to it.

While the grinding mill 6 is thus being operated for maximum production, its rate of production is ascertained at each of a succession of measurement times, and at each such measurement time, according to one mode of practicing the present invention, a projection is made of the estimated total output of the mill for the whole of a milling period which either ends at a predetermined time or continues for a predetermined interval of elapsed milling operation following the measurement time. Each such projection, while it remains valid, is taken as a quota for a corresponding period in the operation of the crushing plant 5, in accordance with the principles disclosed in my copending application, now U.S. Pat. No. 4,179,074. Hence, instead of the crushing plant being operated for attainment of a fixed and more or less arbitrary production quota, its quota may vary from time to time, always being set equal to the then-prevailing estimate of the production that the mill will achieve for its substantially concurrent milling period. The prevailing crushing plant quota is one that is nominally to be attained at the end of a predetermined crushing period; and that crushing period—depending upon how the milling period is set—may end at some predetermined point in time or may be set to end at a time which is advanced at each measurement time and which is taken as the end of a predetermined interval of elapsed crushing operation following the measurement time.

In essence, the quota that is set for the crushing plant at any given time is taken as equal to the then prevailing estimate of the output that the grinding mill will have achieved at a predetermined future time, and the crushing plant is operated with a view towards making good that prevailing quota at that same future time.

It will be evident that the principles set forth in the aforesaid copending application, now U.S. Pat. No. 4,179,074, can be applied to operating the crushing plant on the basis of a quota that is changed from time to time, just as readily as with a fixed quota.

A more detailed understanding of the method of this invention will be obtained from the following explanation of how it can be implemented by means of known measuring and calculating instrumentalities.

In this case a determination or estimate is made of a daily milling period for the mill 6, equal to the average time that the mill is in operation during each working day. In practice the daily milling period can be taken on the basis of experience as the average number of hours per working day that the mill has been in operation over an extended period of working days; and if the mill is subject to partial shut-down, that average is adjusted to an equivalent of full capacity operation.

Under the control of a clock and counter device 21, the daily milling period for the mill 6 is divided into measurement intervals that are preferably equal, each ending at a measurement time. The measurement intervals are measured for actual milling times, which is to say that the clock and counter device 21 is in effect stopped during milling interruptions. At each measurement time the clock and counter device 21 causes a measurement to be taken that produces information from which can be ascertained the total output of the mill 6 from the beginning of the milling period to that measurement time. Each such measurement is made by means of a suitable sensor 22, which can be arranged, for example, to weigh the total quantity of final product at the storage location 9, or to totalize the running weights of final product all through the milling period, or to measure a quantity which bears a known and consistent relationship to weight of produced final product such as volume of material at the storage location.

The information obtained from each such measurement is fed to a rate calculator 23 to which the clock and counter device 21 feeds inputs that denote milling time elapsed since the beginning of the milling period. The rate calculator 23 performs a division function, and its output, which is fed to a multiplying unit 24, corresponds to the rate of production of final product, i.e., tonnage per milling measurement interval. The multiplying unit 24, which also receives an input from the clock and counter device 21, in effect multiplies production rate by the number of measurement intervals still remaining in the milling period, and it produces an output that corresponds to an estimate or projection of the total amount of final product that the mill 6 will have produced by the end of the milling period on the assumption that production to the measurement time was at a constant rate that will be continued to the end of the milling period. That projection or estimate, as explained above, corresponds to the prevailing quota for the crushing plant 5.

For the crushing plant there is also a sensor 27 and a clock and counter device 28. The clock and counter device 28 can in practice be integrated with the similar device 21, but it is illustrated as a separate unit because the crushing period (the average length of time during which the crushing plant operates during each working day) is normally shorter than the milling period, and the crushing period may be divided into crushing measurement intervals of different length than the milling measurement intervals into which the milling period is divided, although preferably the measurement times for the crushing plant 5 coincide with those for the mill 6.

At each crushing plant measurement time, the output of the crushed product sensor 27 is fed to a rate calculator 29 and to a subtraction device 30 which also receives an input from the multiplying unit 24. The subtraction device 30 may also receive a measurement time signal input from the clock and counter device 28 if crushing measurement times do not coincide with milling measurement times. The output of the subtraction device 30 corresponds to the difference between the prevailing quota and crushed product already produced by the crushing plant, and that output is fed to a rate calculator 31 that also receives from the clock and counter device 28 an input corresponding to the number of crushing measurement intervals still remaining in the crushing period. Thus the output of the rate calculator 31 corresponds to the rate of production that must be maintained by the crushing plant after the measurement time, in order for the plant to meet the prevailing quota.

The rate calculator 29 that receives an input from the sensor 27 also receives from the clock and counter unit 28 an input that corresponds to the number of crushing measurement intervals that have elapsed since the beginning of the crushing period. The function of the rate calculator 29 is to calculate the actual rate of production by the crushing plant through the measurement interval that terminates at the current measurement time, and therefore it includes a memory in which there is stored a value corresponding to the amount of crushed product produced through the prior measurement intervals. Subtracting the value stored in the memory from the value for current total production gives the quantity produced during the measurement interval terminating at the current measurement time. If measurement intervals designated by the clock and counter device 21 coincide with those designated by the device 28, then the last mentioned quantity constitutes an actual rate output that is directly comparable with the required-rate output from the rate calculator 31; but otherwise said quantity must be changed to such a comparable rate by a division process employing time unit information from the clock and counter device 28.

The outputs of the calculating devices 31 and 29, respectively corresponding to required and to actual rate of production of crushed product, are compared with one another in a comparator 32. The output of that comparator, which corresponds to required change in the rate of feed to the crushing plant, is fed to a feed rate control instrumentality 33 which in turn controls the speed of the conveyor 11 or its equivalent by which raw material is fed into the crushing plant.

EXAMPLE

The method according to the present invention will be more clearly understood from the following example. It is assumed that a comminuting facility has a crushing plant 5 with a normal crushing period of 18 hours out of each day, feeding into a mill 6 that has a normal milling period of 22 hours during each day. For simplicity it will also be assumed that the two operations begin their working periods at the same time, that the working period is in each case an uninterrupted one, and that every measurement interval is two hours.

Figure 2:
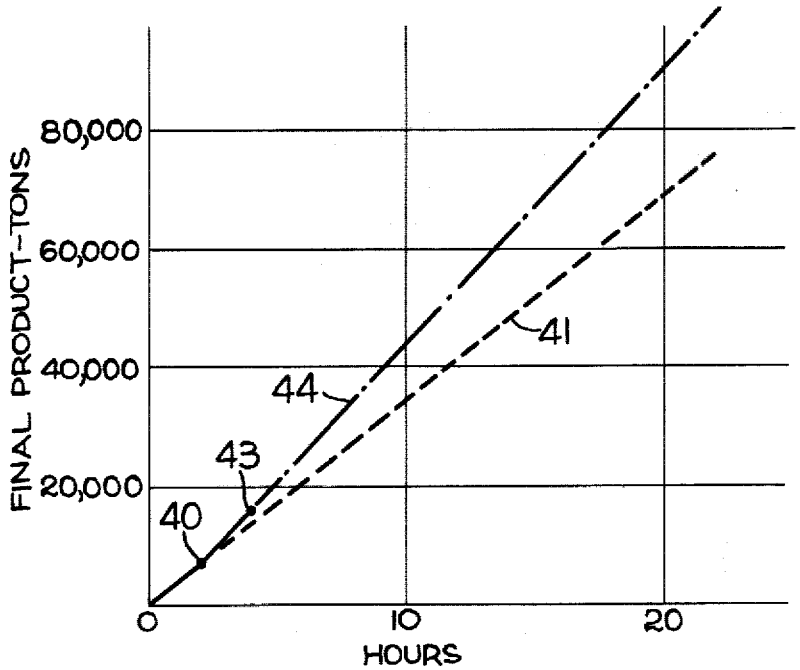
FIG. 2 is a plot of measurements of grinding mill production at two measurement times during a milling period and of projections made from those measurements.

At the end of the first two hours of operation, at the first measurement time, the output of the mill is measured and found to be 6800 tons, as denoted by point 40 in FIG. 2.

Figure 3A:
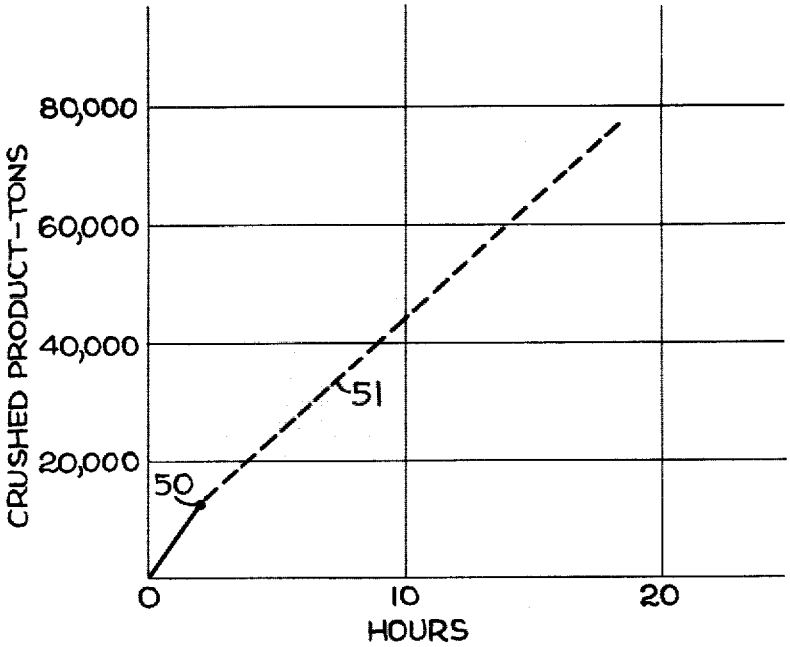

On this information, production for the full 22 hour milling period can be projected at 74,800 tons, as designated by production line 41 in FIG. 2. This estimate now constitutes a currently prevailing quota for the day's production by the associated crushing plant. As shown in FIG. 3a, measurement at the first measurement time shows the crushing plant to have turned out 12,500 tons of crushed product during the first two hours of its crushing period, as denoted by point 50. To make good the prevailing quota, the plant must therefore produce 74,800 minus 12,500 tons, or 62,300 tons during the remaining 16 hours of its crushing period. It should therefore produce at the rate of 7787 tons per measurement interval, as denoted by the slope of line 51. Hence, the feed rate to the crushing plant should be reduced to about 61% of the 12,500 tons per measurement interval maintained during the first two hours.

Figure 3B:
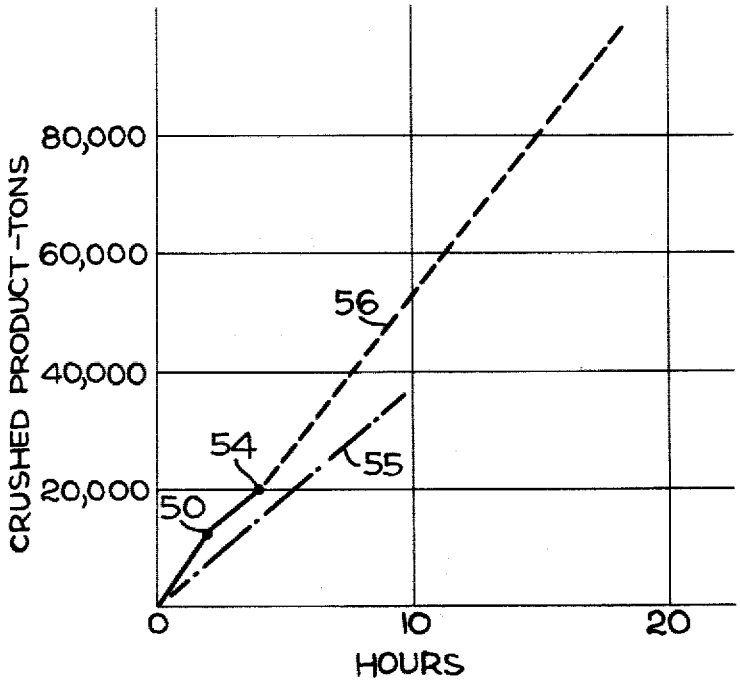

At the second measurement time, at the end of the fourth hour of operation of the grinding mill, its total production for the two measurement intervals is found to have been 16,000 tons, as denoted by point 43 in FIG. 2. Hence its projected production for the full milling period is now 98,800 tons, as denoted by line 44, and this becomes a new prevailing quota for the crushing plant. As shown in FIG. 3*b*, a measurement at the crushing plant, taken at the fourth hour of its crushing period, shows that during the first four hours of that period it produced 20,000 tons, as denoted by the point 54. Since 12,500 tons of this was produced during the first measurement interval, its production during the second measurement interval was at the rate of 7,500 tons per measurement interval, as denoted by the line 55, which is drawn parallel to the line connecting points 50 and 54. If the crushing plant is to produce a total of 98,800 tons (the new prevailing quota) by the end of its crushing period, then, allowing for the 20,000 tons already produced, the crushing plant will have to produce 78,800 tons of crushed product during the remaining 14 hours of its crushing period, or at the rate of 11,143 tons per two-hour measurement interval, as denoted by the slope of line 56. Thus, comparing the slope of line 56 to that of line 55, it will be seen that the rate of feed to the crushing plant must now be increased from 7500 to 11,143 tons per measurement interval, or to about 149% of the immediately previous feed rate.

The process of measuring, estimating and adjusting the crushing plant feed rate is repeated at each measurement time until the end of the crushing period.

In the exaggerated example just given, wherein rate swings are much greater than they might be in actual practice, it can be expected that at the third measurement interval the rate of production of final product will have decreased somewhat, owing to the lower efficiency of the mill as it operates on coarser crushed product, resulting from the increased rate of operation of the crushing plant, and accordingly the new prevailing quota for the crushing plant will be decreased and will call for some decrease in the rate of feed of raw mineral. Assuming a reasonably consistent raw material, the swings in production rates would diminish as time went on.

When the crushing plant is shut down for the day, at the end of its crushing period, it will have produced such quantity of crushed product that the amount of mill feed still remaining at the delivery zone 8 will very closely approximate the amount needed to keep the mill in operation to the end of its milling period. In practice the measurement intervals will normally be substantially shorter than the two hours here used for purposes of a simple example, although if a crushing plant is manually controlled, experience might enable the attainment of good results even with such long measurement intervals.

It will be observed that the method of this invention tends to stabilize the operations of the crushing plant and grinding mill, inasmuch as past production by each during its working period is always taken into account in determining a new feed rate for the crushing plant, thus avoiding "hunting" through large magnitude changes in crushing plant feed rate and consequent large variations in the rate of production of the associated mill.

MODIFIED APPARATUS

Figure 4:
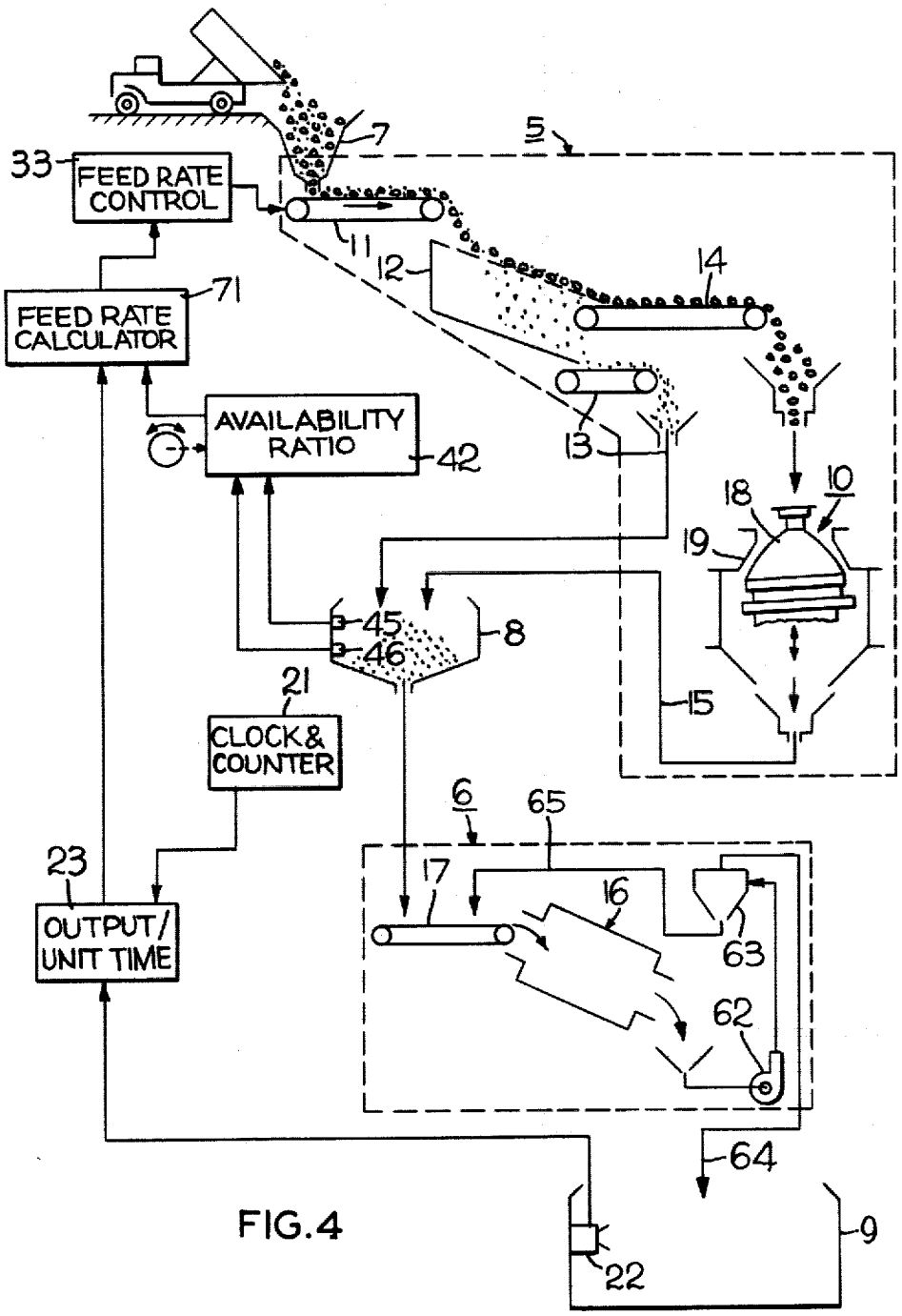
FIG. 4 is a diagrammatic view generally like FIG. 1 but illustrating a modified form of apparatus embodying the invention.

FIG. 4 illustrates a somewhat simplified form of apparatus with which the principles of the invention can be practiced. The crushing plant 5 and the grinding mill 6 are in all essential respects identical with their counterparts in FIG. 1, and the modification is concerned with details of the calculating apparatus.

In a comminuting facility such as that illustrated in FIG. 4, the grinding mill component 6 has a certain availability which can be expressed as a fraction or a percentage and which is equal to the number of hours that the grinding mill is actually in operation during an extended period (e.g., several months), reduced to the equivalent of full-capacity operation, divided by the number of hours that it would be in operation during the same extended period if it did not have to be shut down for repairs and maintenance. A grinding mill can be partially shut down, that is, one unit can be taken out of operation while the remaining units continue to produce. Therefore, for the purposes of calculating availability of the grinding mill 6, its hours of actual operation must be adjusted to compensate for such partial shut-downs and must be reduced to the equivalent of full-capacity operation.

The crushing plant component 5 has a similar availability which can be similarly calculated; and here again, if the crushing plant is capable of partial shutdown, its hours of actual operation must be reduced to the equivalent of full capacity operation for the purposes of the availability calculation.

The availability of each of the components 5 and 6 can be ascertained on the basis of experience or, for a new facility, can be estimated on the basis of prior experience with similar facilities.

Usually the grinding mill component 6 will have a higher availability than the crushing plant component 5. Typically, a crushing plant may have an availability of 85% while an associated grinding mill has a 95% availability.

It can be seen that, as a general rule, the prevailing feed rate to the crushing plant 5 can be equal to the prevailing rate of production of the grinding mill 6 multiplied by the ratio of grinding mill availability to crushing plant availability. Taking the specific values just given, the rate of feed to the crushing plant component 5 should at any given time be substantially equal to the then-prevailing rate at which the grinding mill component 6 produces final product, multiplied by 95/85; or, in other words, the prevailing crushing plant feed rate should be about 112% of the prevailing rate of production of the grinding mill.

To implement the method just explained, the apparatus illustrated in FIG. 4 comprises a clock and counter device 21, a sensor 22 at the storage location 9, and a rate calculating device 23, all arranged and functioning like their counterparts in the FIG. 1 embodiment. In this case, however, the output of the rate calculator 23, which corresponds to rate of production of final product, is fed to a feed rate calculator 71 which also receives an input from an availability ratio instrumentality 42. The availability ratio output can be adjusted manually on the basis of operating and maintenance experience with the facility. In effect, the feed rate calculator 71 multiplies the rate of production of final product by the availability ratio and produces an output which signifies desired prevailing feed rate to the crushing plant 5. That output is in turn delivered to a feed rate control device 33 that controls the speed of the conveyor 11 or its equivalent by which unprocessed material is fed into the crushing plant.

Control of feed rate with the use of the availability ratio in a sense shortcuts the making of projections of production by each component 5, 6, since such projections are inherent in the availability ratio. Over a very long term, as a result of keeping the production rates of the components 5 and 6 generally in step with one another, their respective outputs will theoretically be equal. In this sense, the function of the availability ratio instrumentality 42 in the FIG. 4 apparatus is directly analogous to that of the required rate calculator 31 of FIG. 1. However, the shortcut involved in use of the availability ratio entails some inaccuracies because the mill component will not necessarily continue to produce at the production rate ascertained for it at any given measurement time, availability during any particular short term is not necessarily the same as long-term availability, and there are constant changes in crushability of the unprocessed material and in the amount of product size material transferred directly from the inlet 7 to the delivery zone 8 in bypassing relation to the crushing mechanism.

To compensate for these inaccuracies, the availability ratio can be adjusted empirically whenever the delivery of crushed product to the delivery zone 8 gets substantially out of step with utilization of that product by the grinding mill component 6. In this, again, the grinding mill component 6 serves as the pace-setter, and the crushing plant component 5 is so controlled that its long-term output will substantially equal the long-term production of final product by the grinding mill component 6.

Thus, if after some period of operation, it is found that the amount of crushed product at the delivery zone 8 is building up to a substantial extent, or has diminished to the point where there is only a minimum reserve on hand, the rate of feed to the crushing plant component 5 is decreased or increased as necessary to maintain a stable quantity of crushed product at the delivery zone 8. Such further adjustment can be accomplished manually, by resetting the availability ratio adjustment in accordance with an estimate of the change necessary to bring the components 5 and 6 back into balance.

An automatic adjustment of the availability ratio can be accomplished with the aid of a pair of sensors 45, 46 at the delivery zone 8. The sensor 45 issues an output to the availability ratio instrumentality whenever more than a predetermined nominal maximum quantity of crushed product is present at the delivery zone 8, and the effect of that output is to decrease the availability ratio by an arbitrary amount and thus correspondingly decrease the feed rate. The sensor 46 issues an output whenever crushed product at the delivery zone 8 is below a predetermined minimum reserve quantity, to bring about an increase in the feed rate. Obviously the outputs of the sensors 45 and 46 could be fed directly to the feed rate calculator 71 instead of being fed to it indirectly through the availability ratio instrumentality 42.

In a long-term sense, the control of the feed rate to the crushing plant 5 is in all cases directed to the maintenance of a stable quantity of crushed product at the delivery zone 8 because such stability signifies that the operations of the crushing plant 5 and of the grinding mill 6 are in balance. But shorter-term control of crushing plant feed rate solely on the basis of conditions at the delivery zone 8 might lead to unstable operation, with large swings in feed rate, because it would not take account of different times of shut-down of the crushing plant 5 and grinding mill 6. However, if crushing plant feed rate is basically controlled by reference to grinding mill rate of production, then conditions at the delivery zone 8 can be monitored for an accurate fine tuning of that feed rate.

From the foregoing description and the accompanying drawings it will be apparent that this invention provides a method and apparatus for so operating a comminuting facility comprising a crushing plant and grinding mill as to obtain optimum utilization of both the capital invested in the facility and the energy required for its operation.

The embodiments of the invention in which an exclusive property or privilege is claimed are defined as follows:

1. A method of operating a comminuting facility including a crushing plant (5) to which unprocessed material is fed and by which the material is delivered to a delivery zone (8) as crushed product, and a grinding mill (6) to which said crushed product is fed and which reduces the same to final product (at 9), said method providing for optimum utilization of the capacities of the facility and of the power available to it and comprising the steps of:

A. controlling the grinding mill (6) to produce final product at the maximum rate that is within its existing capabilities while constantly consuming the maximum amount of power available to it;

B. controlling the crushing plant (5) to cause it
(1) to deliver crushed product to the delivery zone (8) at substantially the rate at which unprocessed material is fed to it, and
(2) to constantly consume the maximum amount of power available to it;

C. ascertaining at timed intervals (as by 21, 22, 23) the then prevailing rate at which the grinding mill (6) is producing final product; and D. feeding unprocessed material (as by 11) to the crushing plant (5) at a rate such that the projected quantity of crushed product that would be delivered to the delivery zone (8) at the end of an extended period if said rate were maintained to the end of that period would equal the projected quantity of final product that would be produced by the grinding mill (6) by the end of the same extended period if the grinding mill (6) were to maintain its then prevailing rate of production of finished product to the end of said period.

2. The method of claim 1, further characterized by:
(1) at time intervals (as by 27, 28, 29 or 45, 46) ascertaining the rate at which crushed product is delivered to the delivery zone (8), and
(2) adjusting (as by 27–33, 11 or 45, 46, 42, 41, 33, 11) the rate of feed of unprocessed material to the crushing plant (5) by reference to the relationship between said rate of delivery of crushed product and the then prevailing rate at which the grinding mill (6) is producing final product.

3. The method of claim 2, further characterized by:

(3) ascertaining said rate of production of final product by the grinding mill (6) on the basis of an ascertained (as by 21–23) quantity of final product that the grinding mill (6) has produced since a predetermined earlier starting time;

(4) each time said rate of delivery of crushed product to the delivery zone (8) is ascertained, also ascertaining (as by 27–29) the quantity of crushed product that has been delivered to the delivery zone (8) since a predetermined prior time corresponding to said earlier starting time; and (5) adjusting (as by 29–33, 11) the rate of feed of unprocessed material to the crushing plant (5) by further reference to said ascertained quantities, so that said rate of feed is such that the total projected quantity of final product at the end of said extended period will be equaled by the total projected quantity of crushed product delivered to the delivery zone (8) by the end of said extended period.

4. The method of claim 1 wherein each of the crushing plant (5) and the grinding mill (6) has an availability equal to its operating time over an extended period, reduced to the equivalent of full-capacity operation, divided by the time during that same period during which it would be in operation if it did not need repairs or maintenance, further characterized by:

regulating (as by 41, 42, 33, 11) the rate of feed of unprocessed material to the crushing plant (5) to make it substantially equal to the then prevailing rate at which the grinding mill is producing final product multiplied by the ratio of grinding mill availability to crushing plant availability.

5. The method of claim 4, further characterized by:

(1) monitoring (as by 45, 46) the existing quantity of crushed product present at the delivery zone (8), and (2) further adjusting (as by 45, 46, 42, 33) the rate of feed of unprocessed material to the crushing plant (5) by changing that rate as necessary to maintain said existing quantity of crushed material substantially within predetermined limits.

6. The method of claim 1 wherein the crushing plant (5) operates for a predetermined crushing period that is divided into crushing intervals, each of which terminates at a predetermined crushing measurement time, and wherein the grinding mill (6) operates for a predetermined milling period which substantially corresponds to said crushing period and which is divided into milling intervals, each of which terminates at a milling measurement time, further characterized by:

(1) at each milling measurement time, estimating (as by 21–24) the projected quantity of final product that the grinding mill (6) will have produced by the end of the milling period on the basis of (a) the then-prevailing rate of production of final product, assumed to be maintained to the end of the milling period, (b) the milling time remaining to the end of the milling period, and (c) the quantity of final product produced from the beginning of the milling period to the milling measurement time;

(2) at each crushing measurement time, (a) ascertaining (as with 27–29) the total quantity of crushed product that has been delivered to the delivery zone (8) from the beginning of the crushing period to the crushing measurement time, (b) ascertaining (as with 27–29) the rate at which crushed product has been delivered to the delivery zone (8) during the crushing interval which terminates at the crushing measurement time, and (c) by reference to (i) said rate of delivery of crushed product, (ii) said total quantity of crushed product, and (iii) the crushing time remaining to the end of the crushing period, adjusting (as by 30–33, 11) the rate of feed of unprocessed material to the crushing plant (5) to a value which, if maintained to the end of the crushing period, is calculated to cause the total projected quantity of crushed product delivered to the delivery zone (8) through the crushing period to equal the prevailing estimate of projected quantity of final product.

7. In a comminuting facility that comprises a crushing plant (5) to which unprocessed material is fed (as by 7, 11) and by which the material is delivered to a delivery zone (8) as crushed product, and a grinding mill (6) to which said crushed product is fed and which reduces the same to final product, apparatus for controlling the rate at which unprocessed material is fed to the crushing plant (5) while the crushing plant is so operated that is substantially constantly consumes the maximum amount of power available to it and the grinding mill (6) is so operated that it substantially constantly produces final product at the maximum rate that is within its existing capabilities, said apparatus providing for maintenance of a feed rate that affords optimum utilization of the facility and of energy expended in its operation, and said apparatus being characterized by:

A. clock means (21, 28) for defining a succession of milling measurement times during the operation of the grinding mill (6);

B. a final product sensor (22) for producing an output that is a function of quantity of final product produced;

C. first calculating means (23) connected with said clock means (21) and with said final product sensor (22) for producing at each milling measurement time an output corresponding to the rate at which the grinding mill (6) has been producing final product during an interval which terminates at the milling measurement time;

D. required rate means (24, 28–31, or 42) for producing an output which is a function of the relationship between the amount of time that the crushing plant (5) is in operation during an extended period, reduced to its full-capacity equivalent, and the amount of time that the grinding mill (6) is in operation during a corresponding extended period, reduced to its full-capacity equivalent; and E. second calculating means (32, 33, or 41) connected with said first calculating means (23) and with said required rate means (24, 30, 31, or 42), for producing an output that corresponds to the rate at which unprocessed material must be fed to the crushing plant (5).

8. The comminuting facility of claim 7, further characterized by:

F. crushed product sensor means (27 or 45, 46) at said delivery zone (8) for producing an output which is a function of quantity of crushed product delivered to the delivery zone (8) and which output is fed to said second calculating means (32, 33, or 41).

9. The comminuting facility of claim 8, further characterized by:

(1) said first calculating means (23, 24) comprising means (24) for producing an output which corresponds to the total quantity of final product that will have been produced by the mill (6) by the end of said corresponding extended period if the prevailing rate of production of final product is maintained to the end of that period; and (2) said second calculating means (32, 33) being connected with said clock means (28) and being arranged to produce an output that corresponds to the rate at which crushed product must be delivered to the delivery zone (8) in order for the total quantity of crushed product delivered thereto by the end of said extended period to equal said total quantity of final product.

10. The comminuting facility of claim 8, further characterized by:

(1) said crushed product sensor means (45, 46) comprising (a) a high level sensor (45) which produces an output when the quantity of crushed product at the delivery zone (8) exceeds a predetermined high value and (b) a low level sensor (46) which produces an output when the quantity of crushed product at the delivery zone (8) falls below a predetermined low value; and (2) said second calculating means (41) being arranged to effect a decrease in feed rate in response to an output from said high level sensor (45) and an increase in feed rate in response to an output from said low level sensor (46).

11. The comminuting facility of claim 7 wherein said required rate means (42) comprises manually adjustable means.

* * * * *